US008889252B2

(12) United States Patent
Yun et al.

(10) Patent No.: US 8,889,252 B2
(45) Date of Patent: Nov. 18, 2014

(54) CUTTING INSERT

(75) Inventors: Chol Woen Yun, Daegu (KR); Yong Hyun Jeong, Daegu (KR); Moo Young Yoon, Daegu (KR)

(73) Assignee: TaeguTec, Ltd., Dalsung-gun, Daegu (KR)

( * ) Notice: Subject to any disclaimer, the term of this patent is extended or adjusted under 35 U.S.C. 154(b) by 168 days.

(21) Appl. No.: 13/578,346

(22) PCT Filed: Aug. 26, 2010

(86) PCT No.: PCT/KR2010/005735

§ 371 (c)(1),
(2), (4) Date: Aug. 10, 2012

(87) PCT Pub. No.: WO2011/099683

PCT Pub. Date: Aug. 18, 2011

(65) Prior Publication Data

US 2012/0308845 A1 Dec. 6, 2012

(30) Foreign Application Priority Data

Feb. 11, 2010 (KR) ..... 10-2010-0012965

(51) Int. Cl.
*C23C 28/00* (2006.01)
*C23C 30/00* (2006.01)
*C23C 28/04* (2006.01)

(52) U.S. Cl.
CPC ..... *C23C 30/005* (2013.01); *C23C 28/044* (2013.01); *C23C 28/048* (2013.01); *C23C 28/40* (2013.01); *C23C 28/42* (2013.01); *C23C 28/44* (2013.01)
USPC ..... 428/216; 51/307; 51/309; 428/212; 428/336; 428/697; 428/698; 428/699

(58) Field of Classification Search
CPC .... C23C 28/044; C23C 28/048; C23C 28/40; C23C 28/42; C23C 28/44; C23C 30/005
USPC ..... 51/307, 309; 428/212, 216, 336, 697, 428/698, 699
See application file for complete search history.

(56) References Cited

U.S. PATENT DOCUMENTS 5,700,551 A * 12/1997 Kukino et al. ..... 428/336
6,250,855 B1 * 6/2001 Persson et al. ..... 51/309
(Continued)

FOREIGN PATENT DOCUMENTS

JP 06-316756 A 11/1994
JP H08-134629 A 5/1996
(Continued)

OTHER PUBLICATIONS

International Search Report dated May 2, 2012 issued in PCT counterpart application (No. PCT/KR2010/005735).
(Continued)

*Primary Examiner* — Archene Turner
(74) *Attorney, Agent, or Firm* — Womble Carlyle

(57) ABSTRACT

The cutting tool of the present invention has a base material and a multi-layer coating formed thereon. The multi-layer coating includes an A-layer, a B-layer and a C-layer repeatedly deposited in the order of A-layer, C-layer and B-layer from the base material toward an outer surface of the multi-layer coating. The A-layer has $a_1$ layers and $a_2$ layers wherein 8-20 layers of $a_1$ layers and $a_2$ layers are non-periodically deposited per 100 nm. Each unit layer of the A-layer, B-layer, and C-layer has a thickness of 0.5-2.0 μm, 0.1 μm-0.5 μm and 55-95 nm respectively.

10 Claims, 11 Drawing Sheets

(56) References Cited

U.S. PATENT DOCUMENTS

| | | | | |
|---|---|---|---|---|
| 6,326,093 | B1 * | 12/2001 | Lindholm et al. | 428/699 |
| 7,169,485 | B2 | 1/2007 | Kohara et al. | |
| 7,727,621 | B2 * | 6/2010 | Nordlof et al. | 428/216 |
| 8,257,841 | B2 | 9/2012 | Endler et al. | |
| 8,455,116 | B2 * | 6/2013 | Donnadieu et al. | 51/307 |
| 8,507,109 | B2 * | 8/2013 | Kim et al. | 428/697 |
| 2005/0129986 | A1 | 6/2005 | Sata et al. | |
| 2006/0286410 | A1 | 12/2006 | Ahlgren et al. | |
| 2007/0141346 | A1 | 6/2007 | Nordlof et al. | |
| 2011/0033723 | A1 | 2/2011 | Kim et al. | |

FOREIGN PATENT DOCUMENTS

| | | | |
|---|---|---|---|
| JP | H09-170067 | | 6/1997 |
| JP | 11-061380 | A | 3/1999 |
| JP | 2009-034811 | | 2/2009 |
| KR | 10-0900529 | B1 | 6/2009 |
| WO | 2009/031958 | * | 3/2009 |

OTHER PUBLICATIONS

Written Opinion dated May 2, 2012 issued in PCT counterpart application (No. PCT/KR2010/005735).

Office Action dated Feb. 16, 2012 issued in Korean counterpart application (No. KR 10-2010-0012965) With translation.

Office Action dated Aug. 12, 2013 issued in Chinese counterpart application (No. 201080063356.X).

Office Action dated Sep. 20, 2013 issued in Japanese counterpart application (No. 2012-551897).

Extended European Search Report dated Jan. 22, 2014 issued in European counterpart application (No. 10845853.0).

Official Action dated Mar. 20, 2014 issued in Japanese counterpart appliction (No. 2013-551897).

Pal Dey, S. et al "Single layer and multilayer wear resistant coatings of (Ti,AI)N: a review", *Materials Science and Engineering*, A342 (2003) pp. 58-79.

* cited by examiner (a)

(b)

(a)

(b)

(a)

(b)

(a)

(b)

(a)

(b)

(a)

(b)

(a)

(b)

(a)

(b)

(a)

(b)

CUTTING INSERT

RELATED APPLICATIONS

This is a 35 USC 371 U.S. National Phase of International Application No. PCT/KR2010/005737 filed 26 Aug. 2010 and published in English as WO 2011/099683A1 on 18 Aug. 2011, which claims priority to KR 10-2010-0012965, filed 11 Feb. 2010. The contents of the aforementioned applications are incorporated by reference in their entirety.

TECHNICAL FIELD

The present invention generally relates to cutting tools, and more particularly to cutting tools with a multi-layer coating formed on the surface of the cutting tool.

BACKGROUND ART

Various types of coatings were conventionally used to improve the cutting performance and extend the life of cutting tools. In order to improve the performance of coatings, multi-layer coatings stacked with multiple layers were used, wherein each layer has a thickness of few nanometers. In such multi-layer coatings, the compositions of adjacent layers were configured differently, thereby resulting in different lattice parameters and interaction between adjacent layers. Thus, the hardness and wear resistance of the multi-layer coatings were improved. However, when multiple layers with only a few nanometers of thickness were stacked, there was a problem in that the accumulated torsion stress from the stacked structure caused a decrease in impact-resistance, hence increasing the occurrences of brittle fractures.

In another prior art technology, the toughness and impact-resistance of a multi-layer coating were enhanced by employing an interlaid thick layer, which has a thickness ranging from a few hundred nanometers to a few micrometers, into a structure in which multiple layers were deposited, wherein each multiple layer has a thickness of a few nanometers. The thick layer lowered the high torsion stress caused by the deposited layers, wherein each layer has a few nanometers thickness to improve the toughness and impact-resistance of the multi-layer coating. However, in order to achieve the above, the interlaid layer had to be thick, which consequently lowered the hardness enhancement effect expected by the interaction between the layers with a thickness of few nanometers. This causes a problem of degrading the hardness and wear-resistance of the multi-layer coating.

Thus, the conventional multi-layer coatings could only improve one of the mechanical properties, i.e., hardness or toughness. Accordingly, cutting tools having the multi-layer coatings of the prior art were only limited to achieving one purpose, i.e., high wear-resistance or high impact-resistance. Moreover, since one of the mechanical properties (i.e., either wear-resistance or impact resistance) was relatively inferior compared to the other property, the multi-layer coating of the prior art had limitations in extending the lifespan of the cutting tool.

SUMMARY

An object of the present invention is to enhance the technical properties of both wear-resistance and impact-resistance of the cutting tool, thereby allowing the cutting tool to be used in a wide range of processes requiring either a high wear-resistance or a high-impact resistance. Another object of the present invention is to provide a cutting tool with a multi-layer coating, which remarkably enhances the lifespan of the cutting tool, even with an increase in the cutting speed.

In order to achieve the above objects, the cutting tool of the present invention comprises a base material and a multi-layer coating formed on the surface of the base material. The multi-layer coating comprises an A-layer, a B-layer and a C-layer. The layers are repeatedly deposited in the order of A-layer, C-layer and B-layer from the base material toward an outer surface of the multi-layer coating. The A-layer consists of $a_1$ layers comprising $Ti_{46\sim49}Al_{51\sim54}N$ and having a thickness of 4 nm~30 nm, as well as $a_2$ layers comprising $Ti_{34\sim38}Al_{62\sim66}N$ and having a thickness of 2 nm~25 nm. The $a_1$ layers and $a_2$ layers are non-periodically deposited. The total number of deposited layers of the $a_1$ layers and $a_2$ layers ranges from 8 to 20 per 100 nm. One unit layer of the A-layer includes the deposited layers consisting of the $a_1$ layers and $a_2$ layers, and has a thickness of 0.5~2.0 μm. The B-layer comprises $Ti_{34\sim38}Al_{62\sim66}N$ and one unit layer consisting of the B-layer, and has a thickness of 0.1 μm~0.5 μm. The C-layer comprises $Ti_{46\sim49}Al_{51\sim54}N$ and has a thickness of 55~95 nm.

The total thickness ratio of the B-layer to the A-layer (total B-layer thickness/total A-layer thickness) in the multi-layer coating of the present invention is less than 0.3.

Furthermore, the total thickness ratio of $a_1$ layer to $a_2$ layer (total $a_1$ layer thickness/total $a_2$ layer thickness) in the A-layer ranges from 1.1~2.1.

The A-layer in the multi-layer coating of the present invention has a hardness adjusted to 27~32 GPa. Further, the B-layer has a hardness adjusted to 22~24 GPa, and the C-layer has a hardness adjusted to 26~30 GPa.

According to the present invention, since the mechanical properties of wear-resistance and impact-resistance of a cutting tool are both improved by the multi-layer coating, the cutting tool can be widely used for processes requiring either a high-wear resistance or a high-impact resistance. Also, since both the wear-resistance and the impact-resistance are improved, the cutting blade is highly stable during cutting works. Thus, the lifespan of the cutting tool can be remarkably enhanced even with the increase of cutting speed.

BRIEF DESCRIPTION OF DRAWINGS

FIG. 5(*b*) is a microscopic picture of a part of the A-layer, in which $a_1$ layers and $a_2$ layers are non-periodically deposited.

FIG. 6(*b*) is a microscopic picture of a part of the A-layer in which the $a_1$ layers and the $a_2$ layers are almost periodically deposited.

FIG. 7(*b*) is a graph in which the toughness is compared between the non-periodically deposited $a_1$ layer and $a_2$ layer and the almost periodically deposited $a_1$ layers and $a_2$ layers.

FIG. 8(*b*) is a schematic diagram of the multi-layer coating in which the total thickness ratio of the B-layer to the A-layer (total B-layer thickness/total A-layer thickness) is 0.2.

FIG. 10(*b*) is a picture of the cutting blade after a cutting test wherein an SCM4 workpiece is cut by the cutting tool comprising the multi-layer coating without the C-layer.

FIG. 11(*b*) is a picture of the cutting blade after a cutting test wherein SUS304 workpiece is cut by the cutting tool comprising the multi-layer coating without the C-layer.

FIG. 12(*b*) is a graph showing a comparison in the lifespan of the cutting tool in a cutting process with an Inconel718 workpiece, wherein the comparison is made between the experiment example with the base material (Micro WC—5.5~6.5 wt % Co), in which the B-layer in the multi-layer coating according to the present invention comprises $Ti_{46\sim49}Al_{51\sim54}N$ and the C-layer comprises $Ti_{34\sim38}Al_{62\sim66}N$, and the comparative example in which the multi-layer coating comprises only the A-layer without the B-layer and the C-layer.

DETAILED DESCRIPTION

Detailed embodiments of the present invention will be explained with reference to the drawings.

Figure 1:
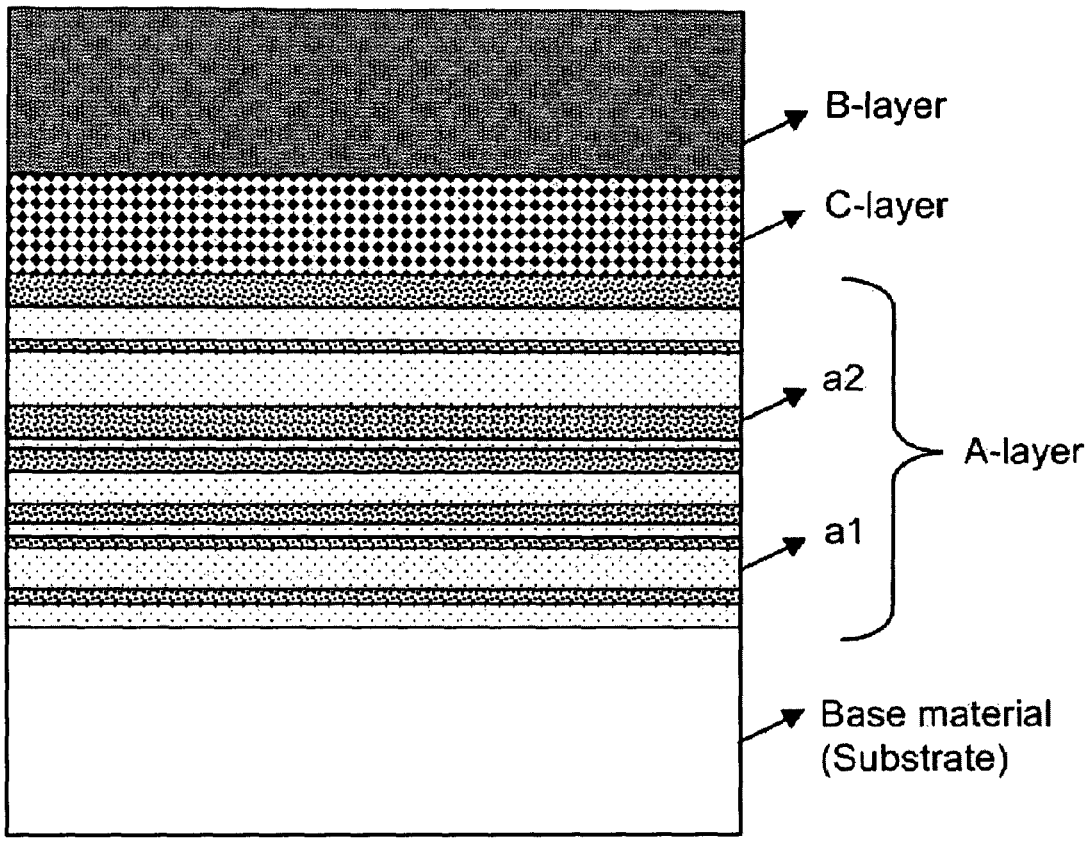
FIG. 1 is a schematic diagram of the cutting tool comprising the multi-layer coating according to the present invention.

FIG. 1 is a schematic diagram of a cutting tool comprising the multi-layer coating according to one embodiment of the present invention. The cutting tool of the present invention comprises a base material and a multi-layer coating formed on the surface of the base material. The base material may be made from materials such as tungsten carbide. The multi-layer coating formed on the surface of the base material comprises an A-layer, a B-layer and a C-layer. The layers are repeatedly deposited in the order of A-layer, C-layer and B-layer from the base material toward an outer surface of the multi-layer coating.

The A-layer comprises $a_1$ layers and $a_2$ layers, both of which have compositions that can remarkably enhance the hardness of the multi-layer coating and which form a depositional structure to improve the toughness of the multi-layer coating. Furthermore, the toughness of the multi-layer coating of the present invention can be enhanced by a B-layer, which has a predetermined thickness. The B-layer relieves the torsion stress generated by the deposition of the $a_1$ layers and $a_2$ layers in the A-layer. Moreover, the multi-layer coating of the present invention is structured such that a C-layer having a predetermined composition and a predetermined thickness is first deposited on the A-layer, wherein the B-layer is then deposited on top of the C-layer. By doing so, the B-layer can be uniformly formed and the toughness enhancement effect by the B-layer can be maximized. As such, the multi-layer coating of the present invention can enhance its toughness by depositing $a_1$ layer and $a_2$ layer non-periodically. The toughness enhancement effect of the B-layer is maximized by the C-layer. Thus, the B-layer, which is necessary for sufficient toughness, can be thinly formed. As the B-layer becomes thin, the thickness ratio of the A-layer increases, which increases the hardness of the entire multi-layer coating. Also, contrary to expectations that the toughness of the entire multi-layer coating would be lowered when the B-layer is formed to be thin, when the total thickness ratio of the B-layer to that of the A-layer (total B-layer thickness/total A-layer thickness) is controlled to be less than 0.3, the toughness of the multi-layer coating is enhanced. Hereinafter, functions and properties of each layer of the multi-layer coating according to the present invention will be explained in detail.

The A-layer is formed by alternately depositing the $a_1$ layers and $a_2$ layers, wherein the $a_1$ layers and $a_2$ layers have compositions different from each other. The $a_1$ layers comprise $Ti_{46\sim49}Al_{51\sim54}N$, while the $a_2$ layers comprise $Ti_{34\sim38}Al_{62\sim66}N$. As such, the hardness enhancement effect caused by the interaction between the layers is maximized. This leads to a remarkable enhancement in the wear-resistance of the multi-layer coating, as well as to a remarkable improvement in the lifespan of the cutting tool. The inventor of the present invention conducted several cutting performance tests with respect to the compositions of the $a_1$ layer and $a_2$ layer, as described below:

Experiment 1

Figure 2:
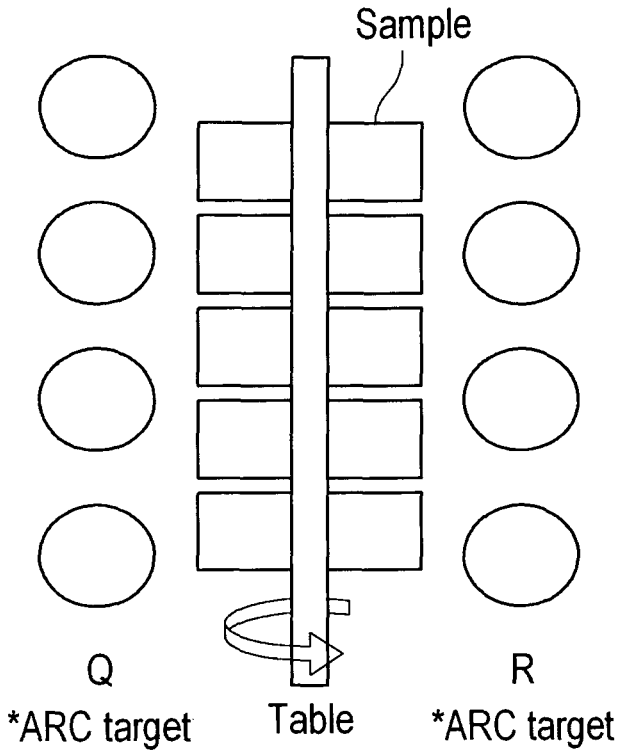
FIG. 2 is an outline drawing of an embodiment of a sputtering device, which is used to form the cutting tool with the multi-layer coating according to the present invention.

In this experiment, the coating was formed on the surfaces of the base material 1 (Micro WC—9~11 wt % Co) and base material 2 (General WC—10~13 wt % Co—1~2 wt % minor metal carbide). The coatings on the surfaces of these two base materials were formed by two types of Arc targets as shown in FIG. 2. Five different types of coatings were then deposited on each base material. In each experiment example, targets with compositions as shown in Table 1 below were used as the Q-position target and the R-position target. In experiment examples 1~4, multi-layer coatings were formed by arranging targets in the Q-position and R-position with different compositions. Further, in experiment example 5, a single-layer coating was formed by arranging the same type of target in the Q-position and R-position with a composition of $Ti_{50}Al_{50}$.

TABLE 1

| Experiment example | Q Target | R Target |
|---|---|---|
| 1 | Ti | $Ti_{50}Al_{50}$ |
| 2 | $Ti_{75}Al_{25}$ | $Ti_{50}Al_{50}$ |
| 3 | $Ti_{75}Al_{25}$ | $Ti_{33}Al_{67}$ |
| 4 | $Ti_{50}Al_{50}$ | $Ti_{33}Al_{67}$ |
| 5 | $Ti_{50}Al_{50}$ | $Ti_{50}Al_{50}$ |

Figure 3:
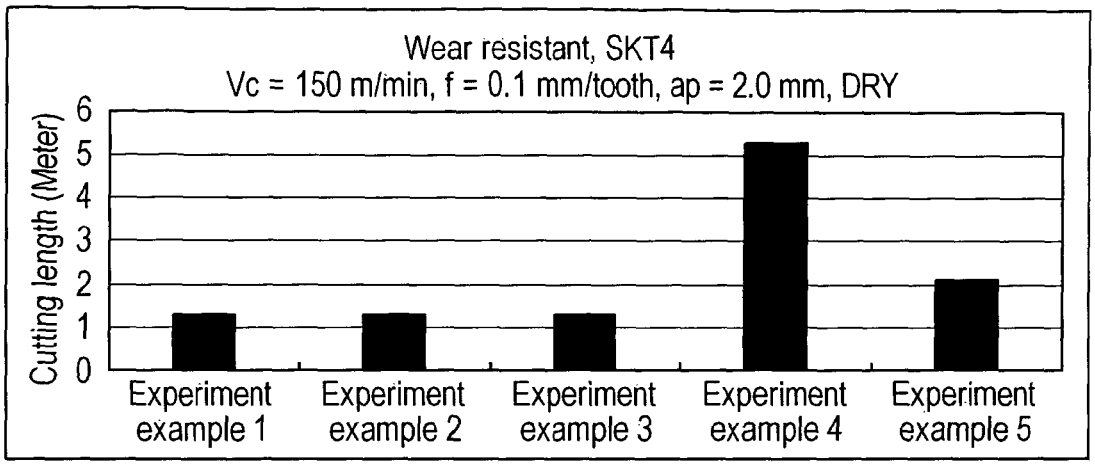
FIG. 3 is a graph in which the cutting tool lifespan is compared when the A-layer is formed with various compositions on the base material 1 (Micro WC—9~11 wt % Co).
Figure 3:
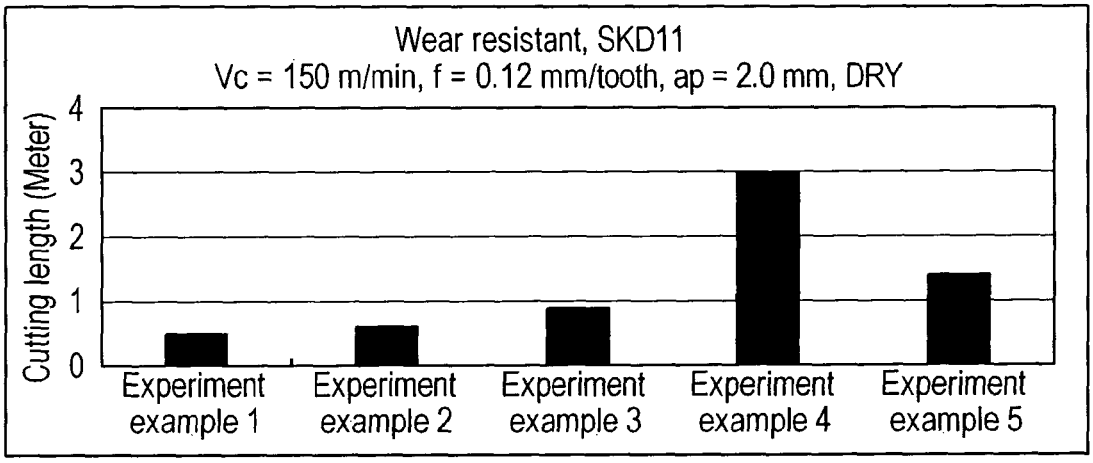
Figure 4:
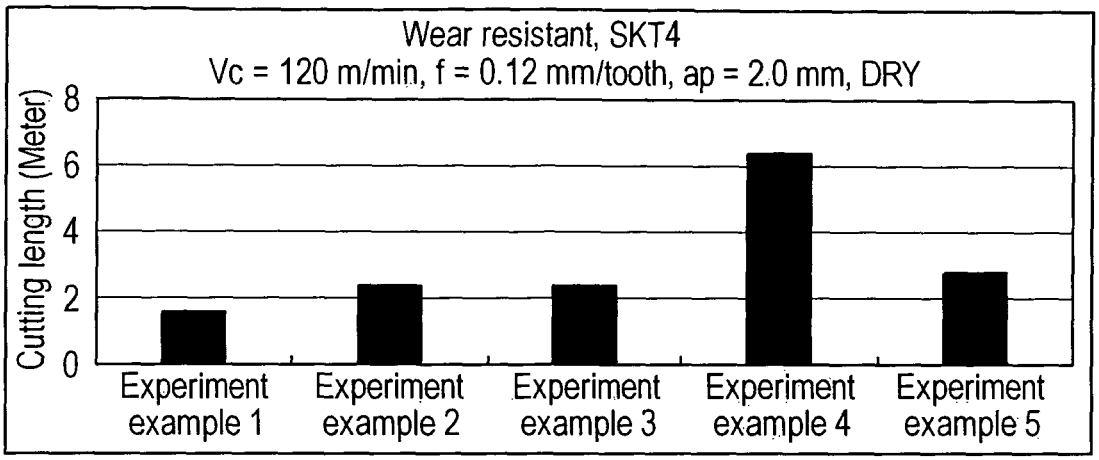
FIG. 4 is a graph in which the cutting tool lifespan is compared when the A-layer is formed with various compositions on the base material 2 (General WC—10~13 wt % Co—1~2 wt % minor metal carbide).
Figure 4:
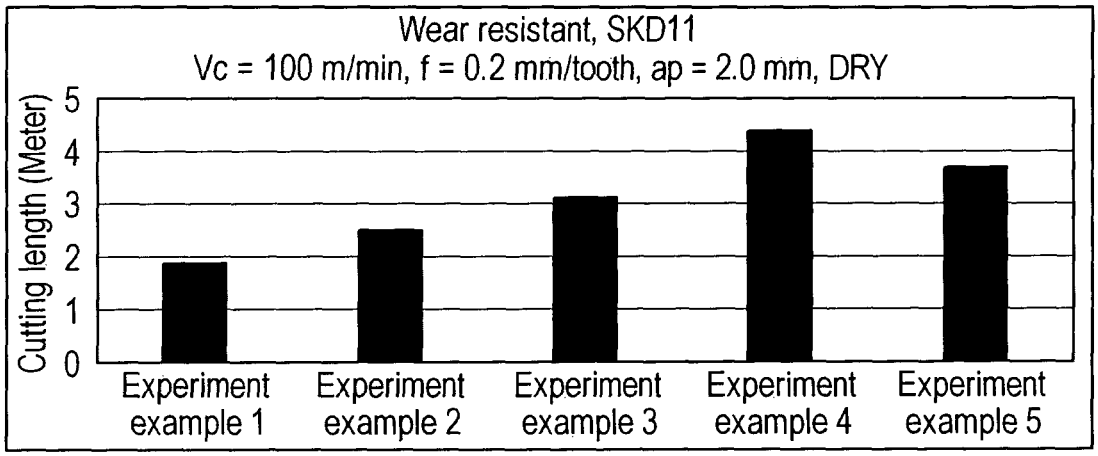

The cutting performance test was conducted by measuring the lifespan of the cutting tool during a cutting process of an SKT4 workpiece and an SKD11 workpiece. The cutting performance test was conducted as follows: the SKT4 workpiece was cut via dry-cutting under conditions of a 150 m/min cutting speed, a 0.1 mm/tooth feeding rate and a 2.0 mm cutting depth. SKD11 workpiece was cut via dry-cutting under the conditions of 150 m/min in cutting speed, 0.12 mm/tooth in feeding rate and 2.0 mm in cutting depth. Both cutting processes used an octagon milling insert. The lifespan of the cutting tool was compared and evaluated by measuring the cutting distance until the abrasion amount of the side surface reached 0.45 mm. FIG. 3 shows the lifespan of the cutting tool comprising the coatings formed on the surface of base material 1, using the targets of each experiment example. FIG. 4 shows the lifespan of a cutting tool comprising the coatings formed on the surface of base material 2, using the targets of each experiment example. FIGS. 3 and 4 confirm that the cutting tool, which comprises the multi-layer coating formed by using the Q-target that has the composition of $Ti_{50}Al_{50}$ and the R-target that has the composition of $Ti_{33}Al_{67}$, has a remarkably enhanced lifespan compared to other experiment examples. The two types of layers of the multi-layer coatings formed by the targets of experiment example 4 were identified to have the compositions of $Ti_{46\sim49}Al_{51\sim54}N$ and $Ti_{34\sim38}Al_{62\sim66}N$. From this, it can be understood that if layers having the compositions of $Ti_{46\sim49}Al_{51\sim54}N$ and $Ti_{34\sim38}Al_{62\sim66}N$ are alternately deposited, then the hardness enhancement expected by the interaction between layers due to the difference in lattice constants can be maximized and the wear-resistance of the multi-layer coating becomes remarkably enhanced. This eventually extends the lifespan of the cutting tool.

Moreover, in the A-layer, the total thickness ratio of the $a_1$ layers to the $a_2$ layers (total $a_1$ layer thickness/total $a_2$ layer thickness) is adjusted to be 1.1~2.1. If the total thickness ratio of the $a_1$ layer to the $a_2$ layer (total $a_1$ layer thickness/total $a_2$ layer thickness) in the A-layer went below 1.1, then the wear-resistance was enhanced, but the impact-resistance was degraded. However, if the total thickness ratio exceeded 2.1, then the impact-resistance increased, but the wear-resistance was decreased. Thus, in order to keep both the wear-resistance and the impact-resistance in good shape, the total thickness ratio of the $a_1$ layer to the $a_2$ layer (total $a_1$ layer thickness/total $a_2$ layer thickness) was limited to be between 1.1 and 2.1.

Further, the thickness of the $a_1$ layers and $a_2$ layers making up the A-layer falls within the range of 4 nm~30 nm and 2 nm~25 nm. Also, they are deposited non-periodically. That is, the $a_1$ layer and $a_2$ layer each have thicknesses in the range as stated above. 8~20 layers of the $a_1$ layers and the $a_2$ layers in total are deposited per 100 nm. One unit layer of the A-layer wherein the $a_1$ layers and $a_2$ layers are deposited as stated above has a thickness of 0.5~2.0 μm. The toughness of the A-layer is remarkably enhanced through such non-periodical deposition. Accordingly, the multi-layer coating of the present invention can provide the functional effect of maximizing the hardness enhancement by the interaction between layers, using $a_1$ layers and $a_2$ layers having the compositions as described above. Furthermore, the multi-layer coating of the present invention can also improve the toughness of the A-layer by depositing the $a_1$ layer and $a_2$ layer such that they have a non-periodical thickness. The inventor of the present invention conducted cutting performance tests with respect to the thicknesses of the $a_1$ layer and $a_2$ layer, as follows.

Experiment 2

Figure 5:
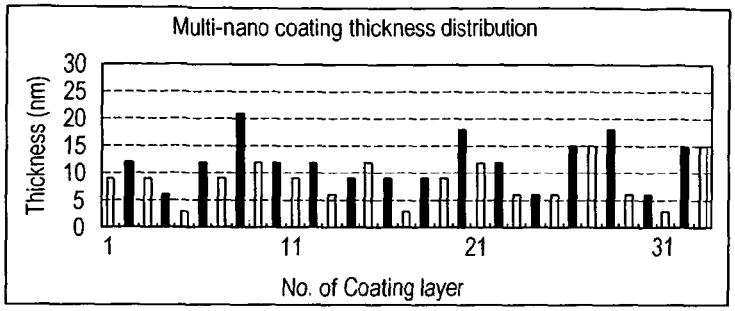
FIG. 5(*a*) is a graph showing the thickness of the non-periodically deposited $a_1$ layers and $a_2$ layers.
Figure 5:
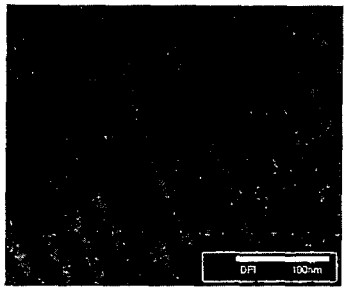
Figure 6:
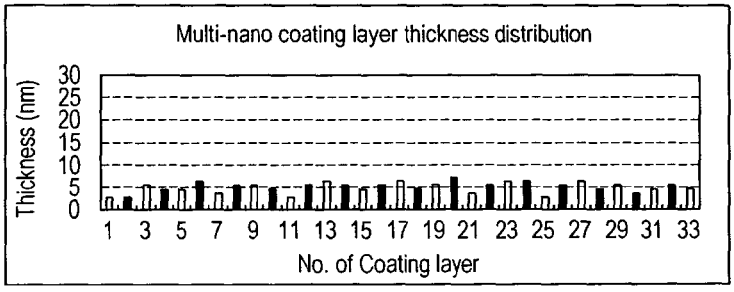
FIG. 6(*a*) is a graph showing the thickness of the almost periodically deposited $a_1$ layers and $a_2$ layers.
Figure 6:
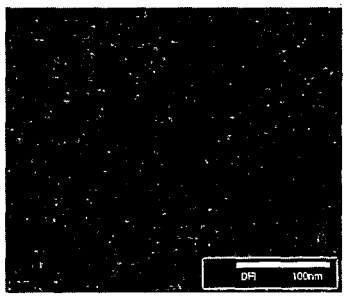

In experiment example 1, $a_1$ layers ($Ti_{47}Al_{53}N$) that had thicknesses of 6 nm~21 nm and $a_2$ layers ($Ti_{37}Al_{63}N$) that had thicknesses of 3 nm~15 nm were non-periodically deposited, as shown in FIG. 5(*a*). FIG. 5(*b*) is a picture of the multi-layer coating of experiment example 1 as observed through a microscope. In experiment example 2, $a_1$ layers ($Ti_{47}Al_{53}N$) that had thicknesses of 3~7 nm and $a_2$ layers ($Ti_{37}Al_{63}N$) that had thicknesses of 3~6 nm were deposited periodically, as shown in FIG. 6(*a*). FIG. 6(*b*) is a picture of the multi-layer coating structure of experiment example 2 as observed through a microscope.

Figure 7:
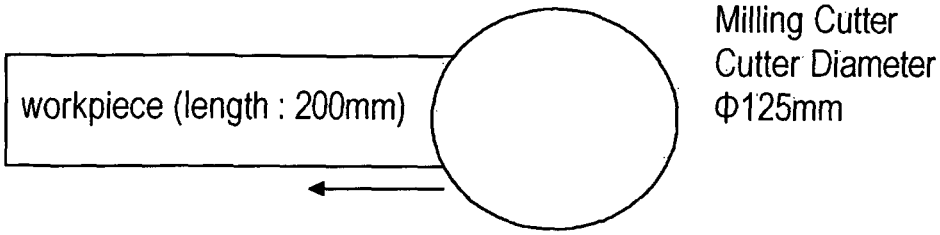
FIG. 7(*a*) shows a method of measuring the toughness of the non-periodically deposited $a_1$ layer and $a_2$ layer and almost periodically deposited $a_1$ layers and $a_2$ layers.
Figure 7:
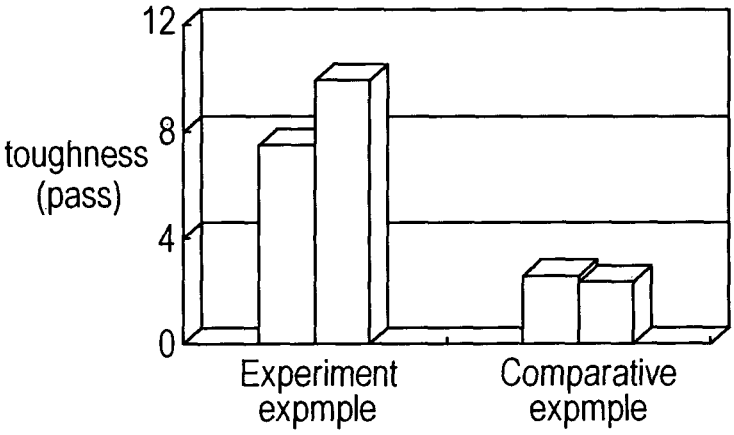

In this experiment, the cutting performance of a cutting tool comprising said two coatings was tested. FIG. 7(*b*) shows two experiment examples of the cutting performance test and the test results from two comparative examples. The cutting performance test was conducted using a milling cutting method as shown in FIG. 7(*a*). The test with the SKT4 workpiece was started with the conditions of V=50 m/min, d=2 mm, dry, and 0.15 mm/tooth initial feeding rate and using a SPKN 1203 type milling insert. Cutting the workpiece 200 mm without damaging the insert was referred to as 1 pass. The test was conducted by increasing the feeding rate by 0.07 mm/tooth interval until the insert was damaged (e.g., 0.15-0.22-0.29-0.36-0.43 . . . ), and the toughness of each insert was relatively evaluated, according to how many "passes" the insert has gone through without damage.

As shown in the result of this experiment, the experiment examples with the non-periodical depositions of the $a_1$ layers and $a_2$ layers demonstrate a toughness two-times greater than the comparative examples, which had an almost periodical deposition.

The B-layer in the multi-layer coating of the present invention has a composition of $Ti_{34\sim38}Al_{62\sim66}N$ and one unit layer of the B-layer has a thickness of 0.1 μm~0.5 μm. Due to the thickness of over 0.1 μm, the B-layer relieves the torsion stress accumulated in the A-layer. Further, since the B-layer has a thickness of under 0.5 μm, it prevents wear-resistance degradation in the multi-layer coating.

In the multi-layer coating of the present invention, the total thickness ratio of the B-layer to the A-layer (total B-layer thickness/total A-layer thickness) is controlled to be less than 0.3. Thus, the functional effect of remarkably enhancing the wear-resistance of the multi-layer coating is provided. The inventor of the present invention conducted a cutting performance test with respect to the total thickness ratio of the B-layer to the A-layer (total B-layer thickness/total A-layer thickness), as follows:

Experiment 3

Figure 8:
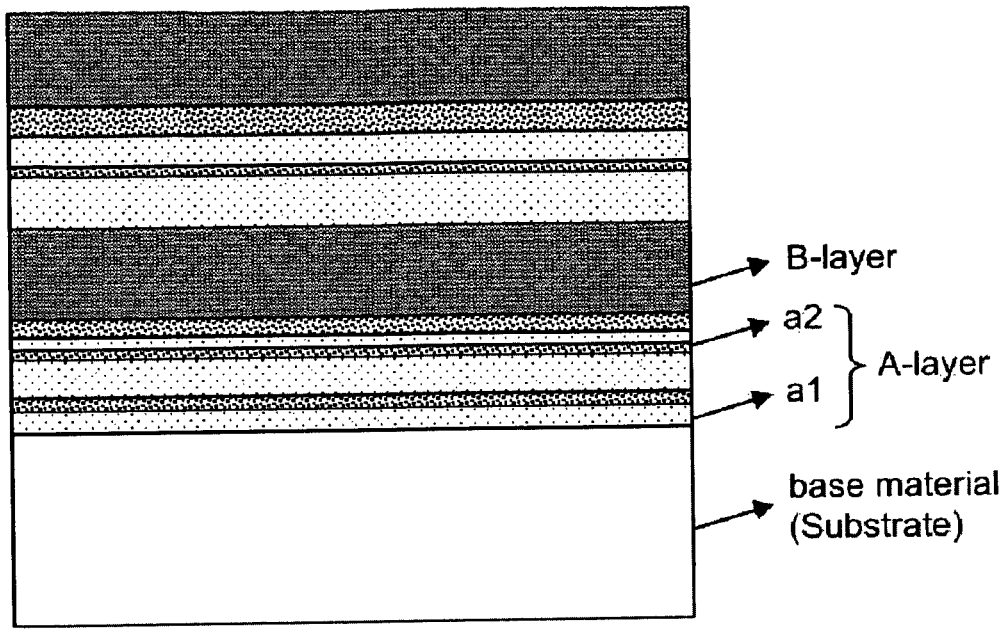
FIG. 8(*a*) is a schematic diagram of the multi-layer coating in which the total thickness ratio of the B-layer to the A-layer (total B-layer thickness/total A-layer thickness) is 1.
Figure 8:
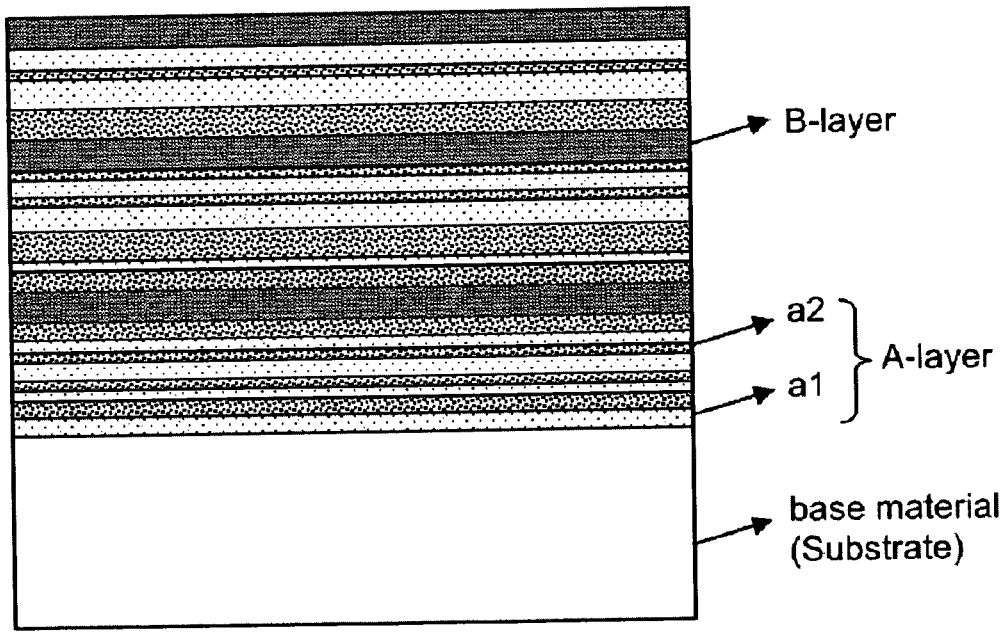
Figure 9:
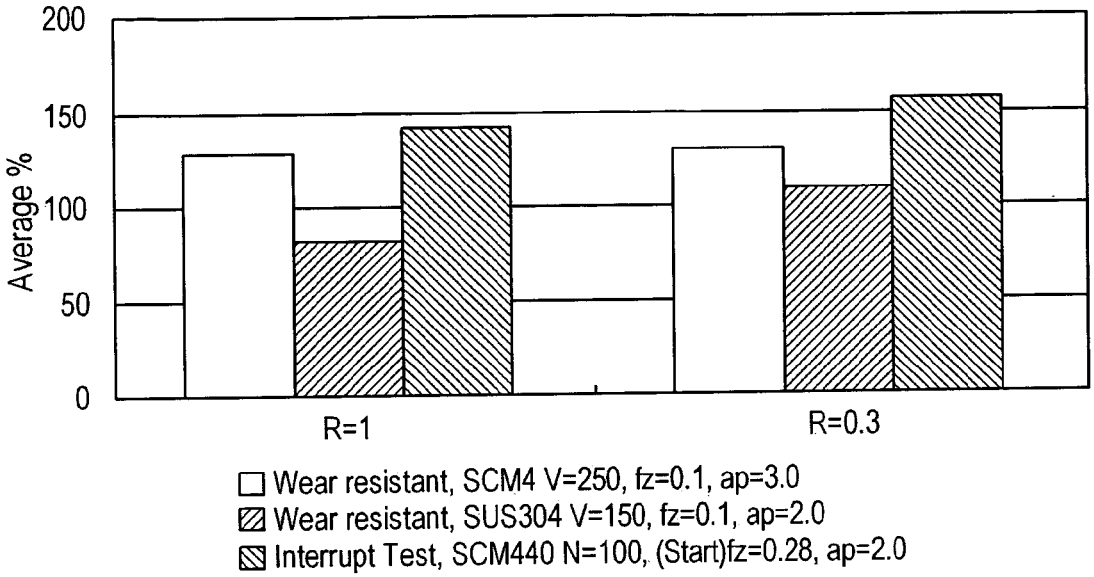
FIG. 9 is a graph in which the wear-resistance and the impact-resistance are compared when the total thickness ratio of the B-layer to the A-layer (total B-layer thickness/total A-layer thickness) is 1 and 0.2.

As shown in FIG. 8(*a*), experiment example 1 of this test shows a cutting performance experiment wherein a multi-layer coating is formed such that the total thickness ratio of the B-layer to the A-layer (total B-layer thickness/total A-layer thickness) is 1. As shown in FIG. 8(*b*), experiment example 2 shows a cutting performance test regarding the wear-resistance and impact-resistance of the cutting tool, wherein a multi-layer coating is formed such that the total thickness ratio of the B-layer to the A-layer (total B-layer thickness/total A-layer thickness) is 0.3. The test on wear-resistance was conducted under two conditions, one with an SCM4 workpiece under conditions of V=250, fz=0.1, ap=3.0, and the other with an SUS304 workpiece under conditions of V=150, fz=0.1, ap=2.0. The test on impact-resistance was conducted with an SCM440 workpiece under conditions of N=100, (Start)fz=0.28, ap=2.0. FIG. 9 presents a graph showing a comparison between the cutting performance test results of experiment examples 1 and 2. The average percentage in FIG. 9 refers to the average lifespan ratio with respect to a cuffing tool comprising a coating without the B-layer.

As shown in the test results provided in FIG. 9, experiment example 1 with the SUS304 workpiece, wherein the total thickness ratio of the B-layer to the A-layer (total thickness of the B-layer/total thickness of the A-layer) is 1, showed that the wear-resistance is rather degraded when compared to the coating without the B-layer. On the other hand, experiment example 2, wherein the total thickness ratio of the B-layer to the A-layer (total B-layer thickness/total A-layer thickness) was controlled to be 0.3, showed that not only the wear-resistance but also the impact-resistance was enhanced. These experiment examples indicate that despite the decrease in thickness ratio of the B-layer, which primarily controls the toughness, the impact-resistance can be enhanced. This is because when the total thickness ratio of the B-layer to the A-layer (total B-layer thickness/total A-layer thickness) becomes less than 0.3, more interfaces are formed between the A-layer and the B-layer. Further, since crack propagation is suppressed by crack separation and crack deflection at the interfaces, the toughness is increased.

The C-layer, which is part of the multi-layer coating of the present invention comprises $Ti_{46\sim49}Al_{51\sim54}N$ and has a thickness of 55~95 nm. The C-layer is always formed on top of the A-layer, and functions as a transfer layer between the A-layer and the B-layer. As the composition and thickness of the C-layer are kept within the above-stated range, the C-layer helps the B-layer form uniformly and helps to maximize the toughness enhancement effect of the B-layer. When the thickness of the C-layer becomes less than 50 nm, it is difficult to form the B-layer uniformly on top of the C-layer since the C-layer cannot cover the entire insert uniformly. When the thickness of the C-layer exceeds 95 nm, the impact-resistance might be degraded. The inventor of the present invention conducted a cutting process with respect to the functional effects of the C-layer under the following conditions. The cutting blade after the cutting is as shown in FIGS. 10 and 11.

Experiment 4

Comparative examples 1~4 of this test employed coatings, which are the same as those used in experiment example 2 of Experiment 3. Such coatings do not comprise the C-layer. Experiment examples 1~4 of this experiment employed the same coating as that used in experiment example 2 of Experiment 3, but with a C-layer this time. Experiment examples 1 and 2, as well as comparative examples 1 and 2, ran the test using an SCM4 workpiece under conditions of V=250 m/min, f=0.1 mm/tooth, d-c=3.0 mm, dry, and a 0.8M cutting length, and the cutting blades were observed thereafter. Experiment examples 3 and 4, as well as comparative examples 3 and 4, ran the test with an SUS304 workpiece under the conditions of V=150 m/min, f=0.1 mm/tooth, d-c=2.0 mm, dry, and a 0.8M cutting length, and the cutting blades were observed thereafter.

Figure 10:
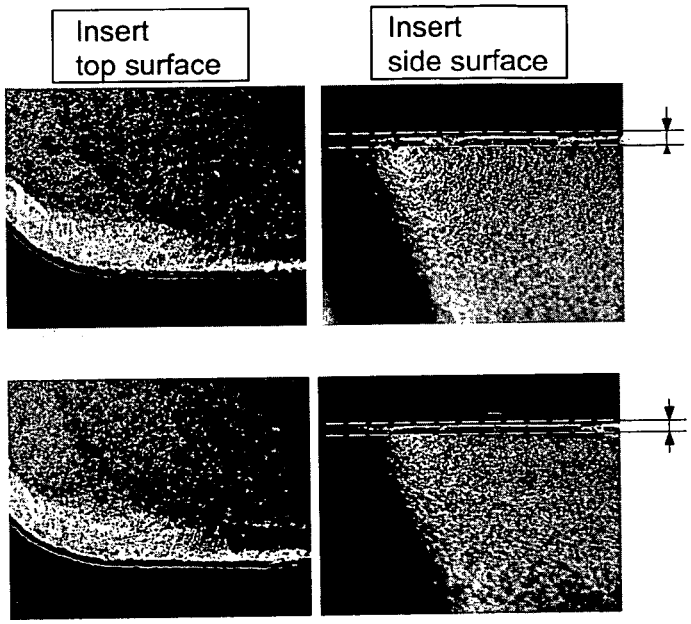
FIG. 10(*a*) is a picture of the cutting blade after a cutting test wherein an SCM4 workpiece is cut by the cutting tool comprising the multi-layer coating with the C-layer.
Figure 10:
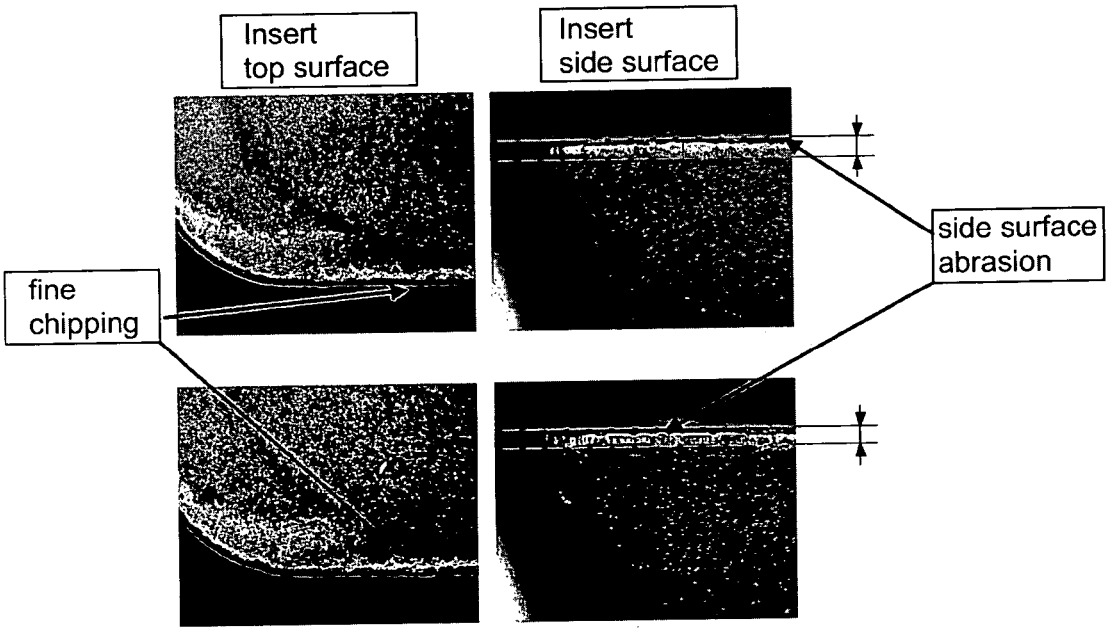
Figure 11:
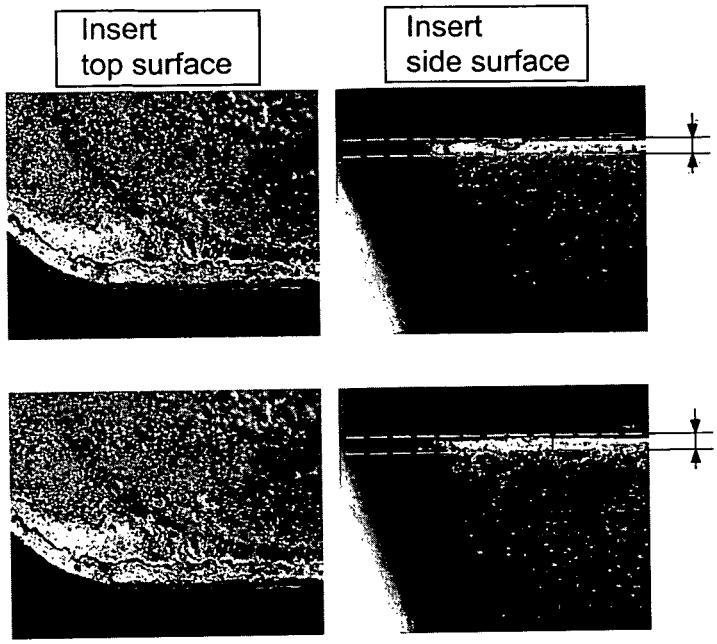
FIG. 11(*a*) is a picture of the cutting blade after a cutting test wherein an SUS304 workpiece is cut by the cutting tool comprising the multi-layer coating with the C-layer.
Figure 11:
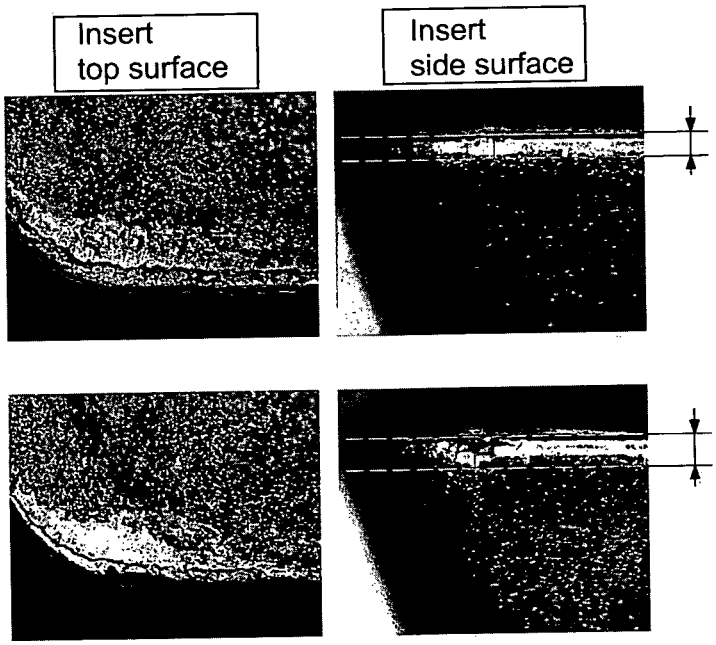

FIG. 10(*a*), which shows experiment examples 1 and 2, and FIG. 10(*b*), which shows comparative examples 1 and 2, indicate that experiment examples 1 and 2 provide a greater excellence in fine chipping and side surface abrasion property, compared to comparative examples 1 and 2. Moreover, FIG. 11(*a*), which shows experiment examples 3 and 4, and FIG. 11(*b*), which shows comparative examples 3 and 4, show that experiment examples 3 and 4 provide a greater excellence in fine chipping and side surface abrasion property, compared to comparative examples 3 and 4. Further, they show that the deviation is smaller in experiment examples 3 and 4 than comparative examples 3 and 4.

From these results, it is clear that the addition of the C-layer maximizes the toughness enhancement effect of the B-layer and leads to further enhancements of the wear-resistance and impact-resistance of the entire coating.

Moreover, the inventor of the present invention conducted the following test in order to confirm the coating performance when the compositions of the B-layer and C-layer are exchanged with each other.

Experiment 5

Figure 12:
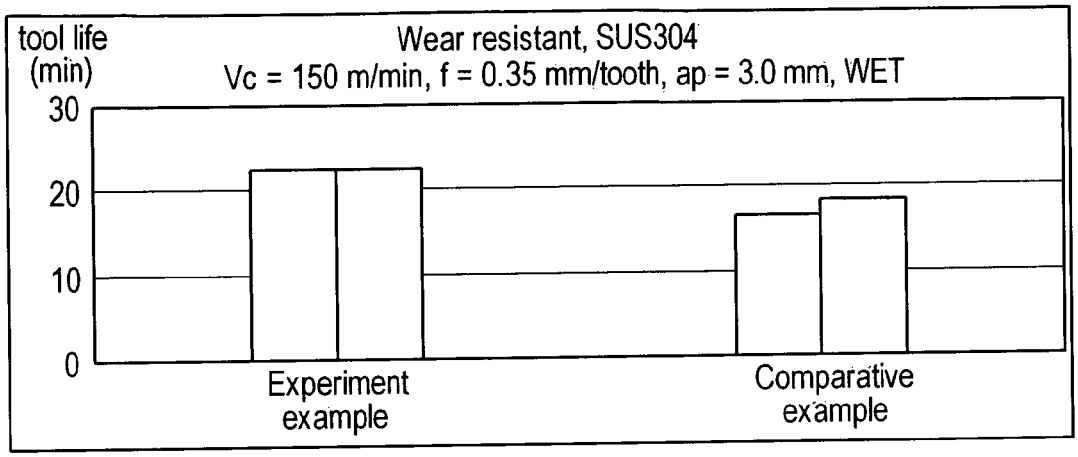
FIG. 12(*a*) is a graph showing a comparison in lifespan of the cutting tool in a cutting process with an SUS304 workpiece, wherein the comparison is made between the experiment example with a base material (Micro WC—5.5~6.5 wt % Co), in which the B-layer in the multi-layer coating according to the present invention comprises $Ti_{46\sim49}Al_{51\sim54}N$ and the C-layer comprises $Ti_{34\sim38}Al_{62\sim66}N$, and the comparative example, in which the multi-layer coating comprises only the A-layer without the B-layer and the C-layer.
Figure 12:
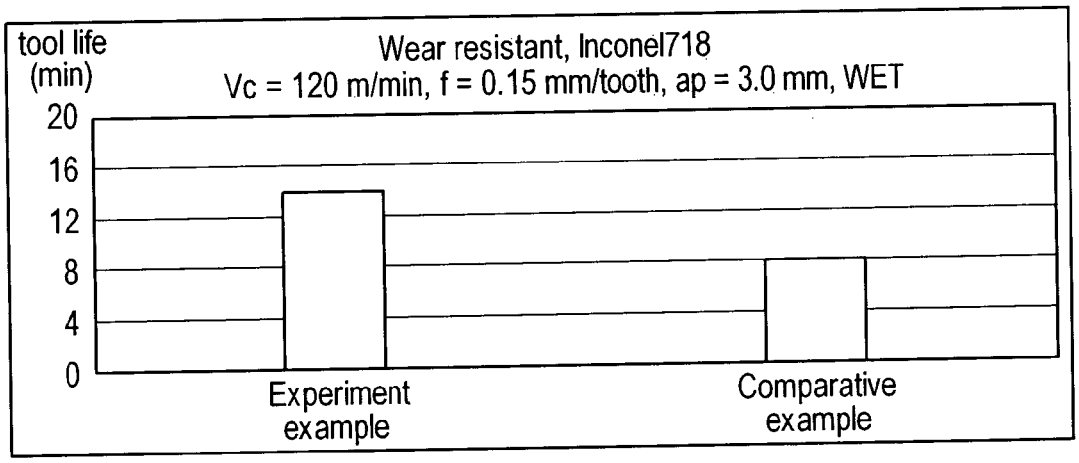

The present experiment switches the composition of the B-layer with the composition of the C-layer in a turning operation test and then compares the results. FIGS. 12(*a*) and 12(*b*) show the performance test results of the multi-layer coatings in the experiment with an SUS304 workpiece and an Inconel718 workpiece, respectively, both using a parallelogram-shaped insert (base material: Micro WC—5.5%~6.5 wt % Co). In the experiment, the multi-layer coating of the experiment example comprises the A-layer, the C-layer and the B-layer as in the present invention. However, the compositions of the B-layer and C-layer are switched with each other (i.e., the B-layer Comprises $Ti_{46\sim49}Al_{51\sim54}N$ and the C-layer comprises $Ti_{34\sim38}Al_{62\sim66}N$). The multi-layer coating of the comparative examples comprises only the A-layer.

This experiment confirms that even though the B-layer and the C-layer are deposited with their compositions being switched with each other, the present invention still performs better than the comparative examples that exclude the B-layer and the C-layer.

As confirmed in the above experiment results, the present invention successfully maximized the hardness enhancement by the interaction between the layers by adjusting the compositional differences in the subordinate layers of the A-layer. Simultaneously, the present invention also enhanced the toughness of the A-layer by depositing the subordinate layers of the A-layer non-periodically. By controlling the total thickness ratio of the B-layer to the A-layer to be less than 0.3, the wear-resistance of the entire coating can be maintained while the impact-resistance is enhanced. Furthermore, by the addition of the C-layer, which helps the B-layer be formed to be uniformly, the uniformity of the B-layer can be enhanced, and the toughness enhancement effect of the B-layer can be maximized. Thus, the present invention successfully keeps both the wear-resistance and the impact-resistance in good shape, thereby providing a cutting tool that can be widely used for various purposes and which has a remarkably enhanced lifespan.

The present invention has been explained with preferable embodiments so far. However, the embodiments are only examples, and the invention is not limited thereto. A person skilled in the art will understand that the present invention can be practiced with various modifications within the scope of the invention.

The invention claimed is:

1. A cutting tool, comprising:

a base material and a multi-layer coating formed on a surface of said base material, said multi-layer coating comprising an A-layer, a C-layer and a B-layer which are repeatedly deposited in an order of A-layer, C-layer and B-layer from the base material toward an outer surface of the multi-layer coating such that the B-layer is an uppermost layer of the multi-layer coating and the C-layer is a second uppermost layer of the multi-layer coating;

the A-layer having a thickness of 0.5-2.0 μm and comprising $a_1$ layers having thicknesses of 4 nm-30 nm and comprising $Ti_{46-49}Al_{51-54}N$, and $a_2$ layers having thicknesses of 2 nm-25 nm and comprising $Ti_{34-38}Al_{62-66}N$, wherein a combined total of 8-20 layers of said $a_1$ layers and $a_2$ layers are non-periodically deposited per 100 nm;

the B-layer having a thickness of 0.1 μm-0.5 μm and comprising $Ti_{34-38}Al_{62-66}N$;

the C-layer having a thickness of 55-95 nm and comprising $Ti_{46-49}Al_{51-54}N$;

wherein a thickness ratio of the B-layer to the A-layer in the multi-layer coating is less than 0.3, wherein the B-layer is at least 4.00 times as thick as any of the $a_2$ layers and the C-layer is at least 1.83 times as thick as any of the $a_1$ layers.

2. The cutting tool according to claim 1, wherein a total thickness of the $a_1$ layers to the $a_2$ layers (total $a_1$ layer thickness/total $a_2$ layer thickness) in the A-layer is 1.1-2.1.

3. The cutting tool according to claim 1, wherein:

the $a_1$ layers all have different thicknesses; and the $a_2$ layers all have different thicknesses.

4. The cutting tool according to claim 1, wherein, within said A-layer, the $a_1$ layers alternate with the $a_2$ layers.

5. A cutting tool, comprising:

a base material and a multi-layer coating formed on a surface of said base material, said multi-layer coating comprising an A-layer, a C-layer and a B-layer which are repeatedly deposited in an order of A-layer, C-layer and B-layer from the base material toward an outer surface of the multi-layer coating such that the B-layer is an uppermost layer of the multi-layer coating and the C-layer is a second uppermost layer of the multi-layer coating;

the A-layer having a thickness of 0.5-2.0 μm and comprising $a_1$ layers having thicknesses of 4 nm-30 nm and comprising $Ti_{46-49}Al_{51-54}N$, and $a_2$ layers having thicknesses of 2 nm-25 nm and comprising $Ti_{34-38}Al_{62-66}N$, wherein a combined total of 8-20 layers of said $a_1$ layers and $a_2$ layers are non-periodically deposited per 100 nm;

the B-layer having a thickness of 0.1 μm-0.5 μm and comprising $Ti_{46-49}Al_{51-54}N$;

the C-layer having a thickness of 55-95 nm and comprising $Ti_{34-38}Al_{62-66}N$;

wherein a thickness ratio of the B-layer to the A-layer in the multi-layer coating is less than 0.3, wherein the B-layer is at least 3.33 times as thick as any of the $a_1$ layers and the C-layer is at least 2.20 times as thick as any of the $a_2$ layers.

6. The cutting tool according to claim 5, wherein a total thickness of the $a_1$ layers to the $a_2$ layers (total $a_1$ layer thickness/total $a_2$ layer thickness) in the A-layer is 1.1-2.1.

7. The cutting tool according to claim 5, wherein:

the $a_1$ layers all have different thicknesses; and the $a_2$ layers all have different thicknesses.

8. The cutting tool according to claim 5, wherein, within said A-layer, the $a_1$ layers alternate with the $a_2$ layers.

9. A cutting tool, comprising:

a base material and a multi-layer coating formed on a surface of said base material, said multi-layer coating comprising an A-layer, a C-layer and a B-layer which are deposited in an order of A-layer, C-layer and B-layer from the base material toward an outer surface of the multi-layer coating such that the B-layer is an uppermost layer of the multi-layer coating and the C-layer is a second uppermost layer of the multi-layer coating;

the A-layer having a thickness of 0.5-2.0 μm and comprising $a_1$ layers having thicknesses of 4 nm-30 nm and comprising $Ti_{46-49}Al_{51-54}N$, and $a_2$ layers having thicknesses of 2 nm-25 nm and comprising $Ti_{34-38}Al_{62-66}N$, wherein a combined total of 8-20 layers of said $a_1$ layers and $a_2$ layers are non-periodically deposited per 100 nm;

the B-layer having a thickness of 0.1 μm-0.5 μm and comprising $Ti_{34-38}Al_{62-66}N$;

the C-layer having a thickness of 55-95 nm and comprising $Ti_{46-49}Al_{51-54}N$;

wherein a thickness ratio of the B-layer to the A-layer in the multi-layer coating is less than 0.3, wherein the B-layer is at least 4.00 times as thick as any of the $a_2$ layers and the C-layer is at least 1.83 times as thick as any of the $a_1$ layers.

10. A cutting tool, comprising:

a base material and a multi-layer coating formed on a surface of said base material, said multi-layer coating comprising an A-layer, a C-layer and a B-layer which are deposited in an order of A-layer, C-layer and B-layer from the base material toward an outer surface of the multi-layer coating such that the B-layer is an uppermost layer of the multi-layer coating and the C-layer is a second uppermost layer of the multi-layer coating;

the A-layer having a thickness of 0.5-2.0 μm and comprising $a_1$ layers having thicknesses of 4 nm-30 nm and comprising $Ti_{46-49}Al_{51-54}N$, and $a_2$ layers having thicknesses of 2 nm-25 nm and comprising $Ti_{34-38}Al_{62-66}N$, wherein a combined total of 8-20 layers of said $a_1$ layers and $a_2$ layers are non-periodically deposited per 100 nm;

the B-layer having a thickness of 0.1 μm-0.5 μm and comprising $Ti_{46-49}Al_{51-54}N$;

the C-layer having a thickness of 55-95 nm and comprising $Ti_{34-38}Al_{62-66}N$;

wherein a thickness ratio of the B-layer to the A-layer in the multi-layer coating is less than 0.3, wherein the B-layer is at least 3.33 times as thick as any of the $a_1$ layers and the C-layer is at least 2.20 times as thick as any of the $a_2$ layers.

* * * * *